United States Patent [19]

Gunti

[11] 4,222,461

[45] Sep. 16, 1980

[54] CONVEYING SYSTEM WITH A DRIVEN RECIPROCATING LOAD-HOLDING DEVICE WHICH IS GUIDED IN A HOLLOW COLUMN

[75] Inventor: Rolf Gunti, Laufen, Switzerland

[73] Assignee: Masyc AG, Munchenstein, Switzerland

[21] Appl. No.: 897,708

[22] Filed: Apr. 19, 1978

[30] Foreign Application Priority Data

Apr. 19, 1977 [CH] Switzerland ..... 4840/77

[51] Int. Cl.[2] ..... B66B 7/00

[52] U.S. Cl. ..... 187/20; 187/9 R; 198/750; 308/3 R

[58] Field of Search ..... 187/20, 9 R, 9 E, 10, 187/11, 6, 7, 8, 21, 95; 308/3 R; 198/750

[56] References Cited

U.S. PATENT DOCUMENTS

| | | | |
|---|---|---|---|
| 668,681 | 2/1901 | French | 187/9 R |
| 713,843 | 11/1902 | Bouck | 187/9 R |
| 1,263,303 | 4/1918 | Wolf | 187/9 R |
| 1,429,012 | 9/1922 | Andrews | 187/95 |
| 2,088,690 | 8/1937 | Crispen | 187/20 |
| 2,241,798 | 5/1941 | Weiss | 187/11 X |
| 3,517,774 | 6/1970 | Meyer | 187/6 |
| 3,847,454 | 11/1974 | Pejcha | 308/3 R X |

*Primary Examiner*—John P. Silverstrim
*Attorney, Agent, or Firm*—Anthony J. Casella

[57] ABSTRACT

A conveying device, particularly suited for lifting purposes comprises a load holding carriage mounted within a hollow column for longitudinal reciprocating movement in the column, the carriage having load holding arms which project transversely from the column through a longitudinal slot in the wall of the column. The carriage has rollers which engage the walls of the column internally to guide the same and a traction chain which is guided around reversing pulleys at the two ends of the column is accommodated within the column, has its opposite ends attached to opposite ends of the carriage to form, with the carriage, an endless loop the run of which not containing the carriage passes the same within the column.

7 Claims, 4 Drawing Figures

CONVEYING SYSTEM WITH A DRIVEN RECIPROCATING LOAD-HOLDING DEVICE WHICH IS GUIDED IN A HOLLOW COLUMN

FIELD OF THE INVENTION

This invention relates to a conveying system, more particularly for lifting purposes, with a reciprocating driven load-holding device which is supported in the interior of a hollow column which functions as guiding element and from which load-holding arms project through a longitudinal slit in the hollow column.

Conveying systems of the kind described hereinbefore are known.

The load-holding device of the known conveying system is constructed as a piston which can be reciprocatingly driven in the hollow column which is constructed as a cylinder.

The known devices suffer from the disadvantage that sealing the cylinder chamber for the piston calls for substantial expenditure in construction and cannot be regarded as reliable in continuous operation.

Another disadvantage of these systems is that their working length cannot be very great or alternatively the expenditure in terms of construction rises superproportionally with an increasing working length.

SUMMARY OF THE INVENTION

It is an object of the present invention to construct a conveyor system of the kind described hereinbefore so that in conjunction with a construction of relatively simple design and with a high degree of reliability in continuous operation it is possible to move loads, more particularly heavy loads, and where appropriate over longer distances or lifting heights which can reach several decks of shelving or floors of buildings in an optimum manner.

According to the invention the problem is solved in a conveying system of the kind described hereinbefore in that the load-holding device comprises a carriage with two carriage parts disposed at a defined distance from each other by means of a rigidly mounted bending-resistant spacer, that each carriage part is provided with a carriage plate the sides of which support roller elements which bear against the internal walls of the hollow column and that each carriage part is mounted at the end of a driven tractive element.

It is an important advantage of the invention that sealing can be completely omitted because a driving piston and the driving means required for driving the same are completely eliminated.

Another important advantage of the invention is due to the fact that loads of substantial weight can be reliably transported over long distances and great lifting heights.

It is also an advantage of the invention that the entire system is contructed from a few and predominantly identical components so that low-cost batch production thereof is possible.

Advantageously the carriage plates have a plan view which is geometrically similar to the internal cross-section of the hollow column but is smaller than this and the hollow column advantageously has a rectangular internal cross-section.

In one advantageous embodiment each roller element cmprises a cylindrical roller member supported on a rotating shaft while in another preferred embodiment the roller elements can be roller bearings or rolling bearings.

According to one further embodiment of the invention each carriage plate is provided on two opposite sides with roller elements disposed at a distance from each other and advantageously only one roller element is provided on two further oppositely disposed sides. Advantageously the two sides each of which have two roller elements can be longer than the other sides.

Advantageously the roller elements are inserted on at least two opposite sides of the carriage plates in bearing recesses thereof. This makes it possible to provide the carriage plates with an optimum large base surface area and therefore load-bearing capacity.

According to the invention the spacer can be a rigid tube which is then advantageously detachably mounted on the carriage plates. According to one further embodiment of the invention the spacer is however of variable length and is advantageously constructed as a lockable telescopic tube.

One further embodiment of the invention envisages a load-holding arm on each carriage plate and a load bracket can be advantageously attached to the load-holding arms and according to one further embodiment a section of a conveying system can be attached to the load bracket.

Advantageously the load bracket is constructed in the form of a support bracket with a mounting plate and a support plate and advantageously the bracket angle formed by the support plate with the mounting plate corresponds to the angle of inclination of the hollow column in the operating position thereof with respect to the horizontal and advantageously the bracket angle is adjustable.

Advantageously the tractive element is a traction chain which is guided over reversing pulleys supported on the ends of the hollow column and one of the reversing pulleys is embodied as a driving pinion and is coupled to a reversible driving device. Advantageously the tractive element is reversed in the interior of the hollow column between the reversing pulleys and to this end extends through openings of the carriage plates.

According to one further embodiment of the invention the hollow column can be mounted on a track and advantageously a truck which bears against a top support surface can be provided at the other end of the hollow column.

In addition to being rectangular or polygonal the contour of the carriage plates and/or the internal cross-section of the hollow column can also be free of corners, more particularly they can be constructed in circular form.

One important advantage of the invention is that limit switches by means of which any desired working travel of the carriage can be automatically defined, can be attached to any desired place of the walls associated with the hollow column.

The invention will now be described hereinbelow by reference to the accompanying drawing.

DESCRIPTION OF THE PREFERRED EMBODIMENT

Figure 1:
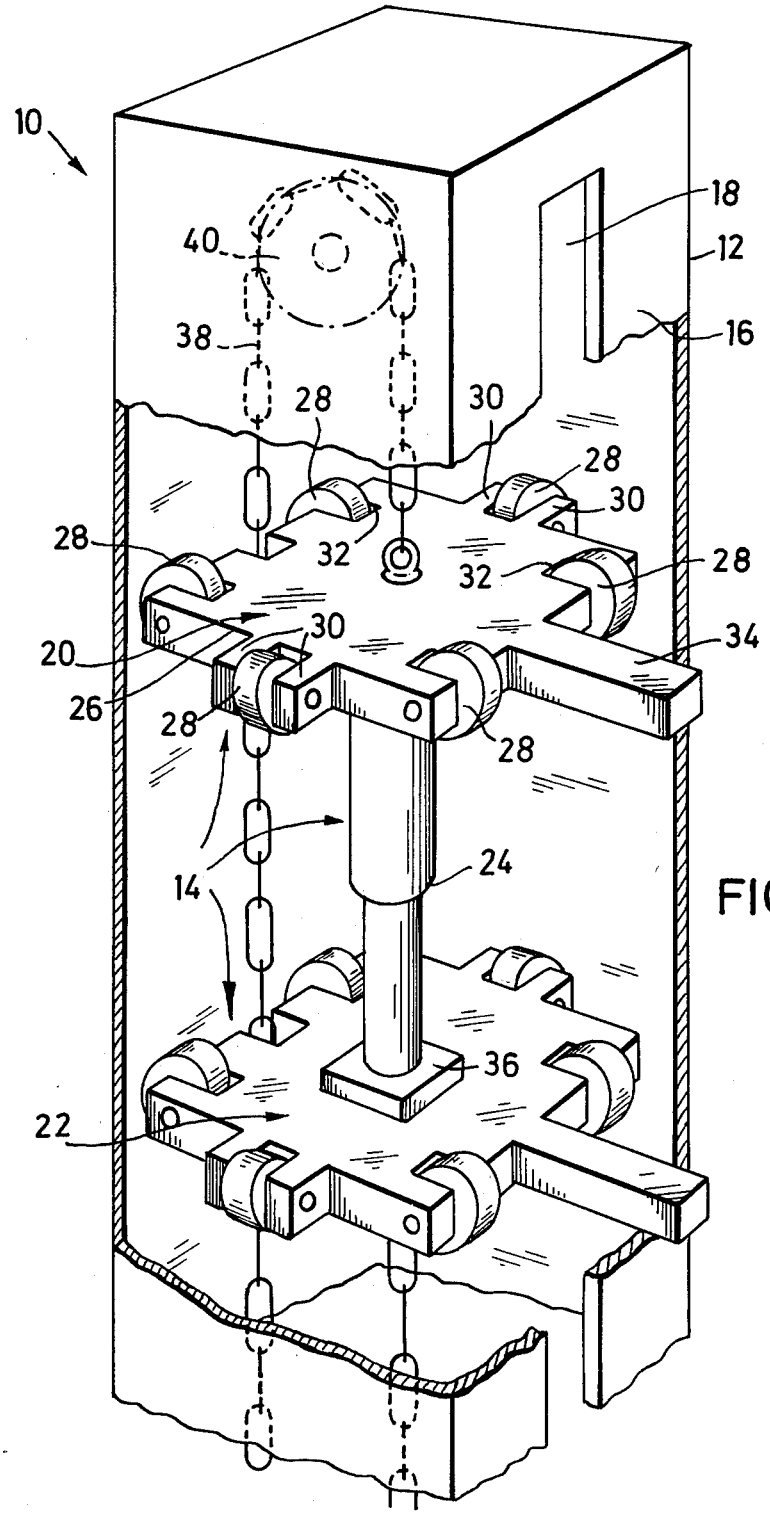
FIG. 1 is a partially fractionated perspective view of a column lifting device according to the invention whose carriage is shown in greater detail.

According to the drawing a column lifting device 10 comprises a hollow column 12 which functions as column guide and a carriage 14 which is supported in the hollow column 12.

The hollow column 12 is a rectangular tube which is closed on both end sides and whose longitudinal wall 16 is constructed with a continuous longitudinal slit 18. The hollow column can be of any desired length and if necessary can extend over several decks of storage racking or floors of a building.

In the illustrated embodiment the internal cross-section of the hollow column is rectangular and the longitudinal slit 18 is disposed on the middle longitudinal plane of the side wall 16.

According to FIG. 1 the carriage 14 comprises two carriage parts 20 and 22 which are held at a defined distance from each other by means of a spacer 24.

The carriage part 20, whose construction is identical to that of the carriage part 22, comprises a carriage plate 26 the base area of which is geometrically similar to the internal cross-section of the hollow column but is smaller than this i.e. the plan view of the carriage plate 26 is also rectangular.

Rollers which comprise roller members supported on a rotating shaft are supported on each side of the carriage plate 26. One roller 28 each is inserted into a bifurcated extension 30 on the two sides of the carriage plate 26 which are slightly shorter and two rollers 28 are inserted into associated recesses 32 on each of the two other and slightly longer oppositely disposed sides of the carriage plate 26 and are disposed in the end regions of such sides. The rollers 28 inserted into the recesses 32 project with part of their circumference beyond the outside of the carriage plate 26.

On the side nearest to the longitudinal slit 18 in the hollow column 12 the carriage plate 26 is provided with a load-holding arm 34 which extends from the interior of the hollow column 12 through the longitudinal slit 18 to the outside of the hollow column 12 and projects therefrom by a defined amount.

Since the carriage part 22 is constructed in the same way as the carriage part 20 it will not be further described.

In the illustrated embodiment the spacer 24 comprises a bending-resistant longitudinally adjustable telescopic tube each end of which is provided with an end plate 36 by means of which it is attached to inward facing surfaces of the carriage parts 20 and 22. The spacer 24 can also comprise an integral tube in place of the telescopic tube. If the spacer 24 is detachably connected to the carriage parts 20 and 22 and a plurality of such integral tubes of defined but different longitudinal dimension are available it is possible by simple exchanging of such tubes to set different distances between the carriage parts 20 and 22.

A traction chain 38 is guided in the interior of the hollow column about a reversing pulley 40 which is supported at the top end of the hollow column 12 and is guided about a driving pinion 42 which also functions as reversing pulley and is supported at the bottom end of the hollow column 12 and one end of said chain is secured on the top of the carriage part 20 and the other end is secured on the bottom of the carriage part 22. The driving pinion 42 is coupled via a drive shaft to a reversible electric motor 44.

Figure 2:
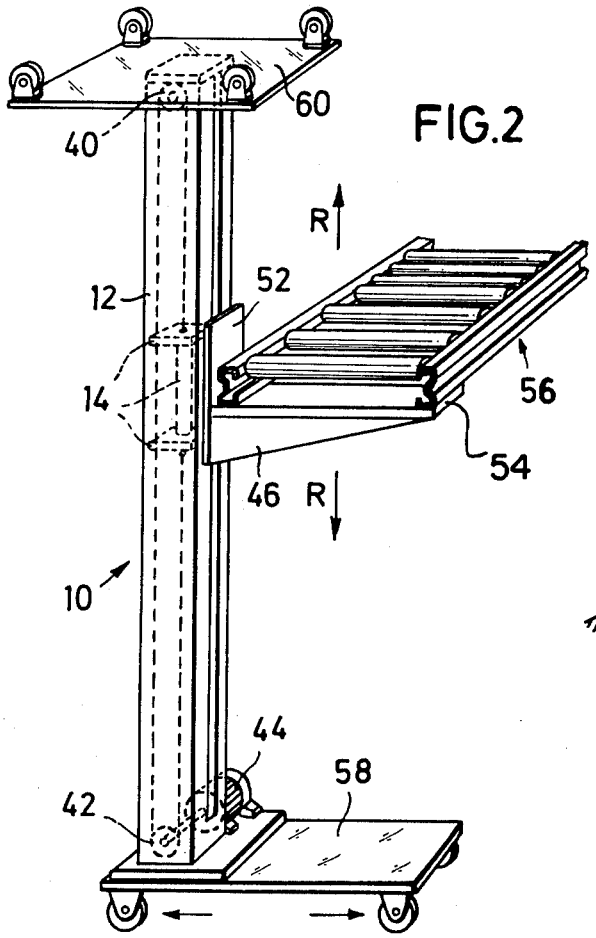
FIG. 2 is a perspective view of a column lifting device placed on a carriage with a sealing support truck mounted on the top end thereof and one portion of a roller conveyor is attached to the load bracket.
Figure 3:
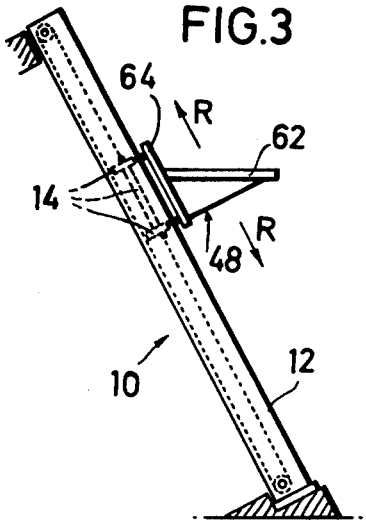
FIG. 3 shows a column lifting device with a hollow column set at an angle and a load bracket whose support plate is aligned in the direction of the horizontal and FIG. 4 shows the column lifting device illustrated in FIG. 1 with a horizontally disposed hollow column for use as a conveying system which can reciprocate in the horizontal direction.
Figure 4:
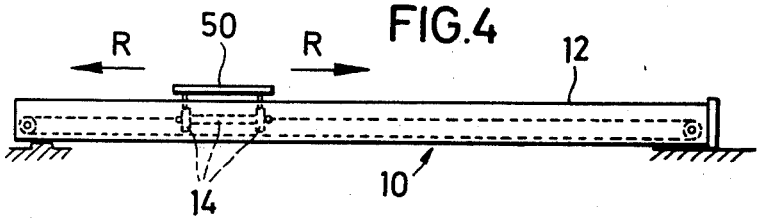

According to FIGS. 2 to 4 different load brackets 46, 48 or 50 can be attached to the load-holding arms 34.

According to FIG. 2 the load bracket 46 is constructed in angular form and comprises a mounting plate 52 and a support plate, the bracket angle formed by the mounting plate 52 and the support plate 54 being 90°. The support plate 54 is also supported by cantilever arms which are also mounted on the mounting plate 52. Furthermore a portion 56 of a roller conveyor which can be raised and lowered by means of the carriage 14 in the direction of the arrow R is also mounted on the support plate 54.

The column lifting device is also mounted on a truck 58 and is additionally provided with a further truck 60 at the top end of the hollow column 12. In this way the column lifting device according to the invention can traverse while being supported against the ceiling and floor of a room in which a roller conveyor system is disposed in order to handle piece goods. If the portion 56 of the roller conveyor system is omitted the column lifting device can also be utilized for transferring piece goods between different storage places. Even piece goods of heavy weight can be transferred since the column lifting device bears against the floor as well as against the ceiling.

If the hollow column 12 of the lifting device according to FIGS. 3 and 4 is arranged at a finite angle with respect to the vertical it is also possible for piece goods to be reciprocated over a sloping distance or over a horizontal distance. The support plate 62 of the load bracket 48 according to FIG. 3 will then be inclined with respect to the mounting plate 64 at the angle which the hollow column forms with the horizontal. In the case of FIG. 4 the mounting plate 50 is also provided as a support plate because in this case the angle of the hollow column 12 with respect to the horizontal is 0°.

I claim:

1. A conveying device comprising a hollow column, a load holding device disposed in the interior of the hollow column and mounted for reciprocating longitudinal movement in said column, driving means for driving said load-holding device reciprocatingly in said column, the hollow column functioning as a guiding element for the load holding device, the hollow column having a longitudinal slit, the load holding device having load holding arms projecting laterally from the column through said slit, said load holding device being in the form of a carriage which comprises two carriage parts spaced apart from each other in the longitudinal direction of the column and a rigid bend-resistant spacer of adjustable length extending between and fixed to said carriage parts, each said carriage part comprising a carriage plate, roller elements, means mounting said roller elements rotatably at the sides of the carriage plate to bear upon the interior walls of the hollow column to roll along said walls during longitudinal movement of the load-holding device in said column, said driving means including a tractive element having an end connected to each said carriage part.

2. The device of claim 1 in which said spacer is constructed as a lockable telescopic tube.

3. A conveying device comprising a hollow column, a load holding device disposed in the interior of the hollow column and mounted for reciprocating longitudinal movement in said column, driving means for driving said load-holding device reciprocatingly in said column, the hollow column functioning as a guiding element for the load holding device, the hollow column having a longitudinal slit, said load holding device being in the form of a carriage which comprises two carriage parts spaced apart from each other in the longitudinal direction of the column and a rigid bend-resistant spacer of adjustable length extending between and fixed to said carriage parts, each said carriage part comprising a carriage plate, roller elements, means mounting said roller elements rotatably at the sides of the carriage plate to bear upon the interior walls of the hollow column to roll along said walls during longitudinal movement of the load-holding device in said column, each said carriage plate having a load holding arm extending therefrom and projecting laterally from the column through said slit, said driving means including a tractive element having an end connected to each said carriage part.

4. The device of claim 3 including a load bracket and means attaching said load bracket to said load-holding arms.

5. The device of claim 4 in which said load bracket includes a mounting plate and a support plate connected to each other to form an angle therebetween.

6. The device of claim 5, in which the angle formed between said support plate and said mounting plate corresponds to the angle of inclination of the hollow column in the operating position thereof with respect to the horizontal.

7. A conveying device comprising a hollow column, a load holding device disposed in the interior of the hollow column and mounted for reciprocating longitudinal movement in said column, driving means for driving said load-holding device reciprocatingly in said column, the hollow column functioning as a guide element for the load holding device, the hollow column having a longitudinal slit, the load holding device having load holding arms projecting laterally from the column through said slit, said load holding device being in the form of a carriage which comprises two carriage parts spaced apart from each other in the longitudinal direction of the column and a rigid bend-resistant spacer of adjustable length extending between and fixed to said carriage parts, each said carriage part comprising a carriage plate, roller elements, means mounting said roller elements rotatably at the sides of the carriage plate to bear upon the interior walls of the hollow column to roll along said walls during longitudinal movement of the load-holding device in said column, said drive means including a tractive element having an end connected to each said carriage part, and a conveying facility attached to said load holding arms of said load holding device.

* * * * *